US011524499B2

(12) United States Patent
Ozaki et al.

(10) Patent No.: US 11,524,499 B2
(45) Date of Patent: Dec. 13, 2022

(54) SUBSTRATE, LIQUID EJECTION HEAD, AND MANUFACTURING METHOD THEREOF

(71) Applicant: CANON KABUSHIKI KAISHA, Tokyo (JP)

(72) Inventors: Noriyasu Ozaki, Atsugi (JP); Takayuki Kamimura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 273 days.

(21) Appl. No.: 16/902,628

(22) Filed: Jun. 16, 2020

(65) Prior Publication Data

US 2020/0391511 A1 Dec. 17, 2020

(30) Foreign Application Priority Data

Jun. 17, 2019 (JP) ..... JP2019-111877

(51) Int. Cl.
*B41J 2/16* (2006.01)
*B41J 2/14* (2006.01)

(52) U.S. Cl.
CPC ..... *B41J 2/1628* (2013.01); *B41J 2/1642* (2013.01); *B41J 2/1639* (2013.01)

(58) Field of Classification Search
CPC ..... B41J 2/1628; B41J 2/1642; B41J 2/1639; B41J 2/135; B41J 2/14032; B41J 2/1429; B41J 2/1433
See application file for complete search history.

(56) References Cited

U.S. PATENT DOCUMENTS 5,608,436 A * 3/1997 Baughman ..... B41J 2/1603 347/65
6,502,930 B1 * 1/2003 Shimada ..... B41J 2/1629 347/71
2008/0018713 A1 * 1/2008 Lopez ..... B41J 2/1639 347/68
2008/0217290 A1 * 9/2008 Yokouchi ..... B41J 2/1646 216/27

FOREIGN PATENT DOCUMENTS

JP 2011-161915 A 8/2011

* cited by examiner

*Primary Examiner* — Jason S Uhlenhake
(74) *Attorney, Agent, or Firm* — Canon U.S.A., Inc. IP Division

(57) ABSTRACT

A substrate includes a first substrate which has a first substrate through hole, and a second substrate which has a second substrate through hole and directly or indirectly overlaps the first substrate, the first substrate through hole and the second substrate through hole directly or indirectly communicate with each other to form a liquid supply path and a width D1 of an opening portion of the first substrate through hole on a surface of the first substrate closer to the second substrate, a width D2 of an opening portion of the second substrate through hole on a surface of the second substrate closer to the first substrate, a width D3 of an opening portion of the second substrate through hole on a surface of the second substrate farther from the first substrate have a relationship of D1<D2 and D3<D2.

13 Claims, 13 Drawing Sheets

SUBSTRATE, LIQUID EJECTION HEAD, AND MANUFACTURING METHOD THEREOF

BACKGROUND OF THE DISCLOSURE

Field of the Disclosure

The present disclosure relates to a substrate, a liquid ejection head and a manufacturing method thereof.

Description of the Related Art

A general liquid ejection head includes an ejection orifice forming member which ejects a liquid, an element substrate on which an energy generating element (for example, an electrothermal conversion element) which generates energy for ejecting the liquid is disposed and a support member which supports the element substrate. In a liquid ejection head which circulates different liquids within one element substrate in order to eject a plurality of different liquids (for example, multicolor liquid ink), it is necessary to prevent mixing and leakage of different liquids. Therefore, a high sealing property is required at a joint between the element substrate and the support member and the joint requires a large area.

Meanwhile, in order to increase a speed and frequency of liquid ejection, it is desired to increase a width of a supply path for supplying a liquid to a pressure chamber including the energy generating element. However, as described above, in order to enhance the sealing property between the element substrate and the support member so as to prevent the liquid from leaking or being mixed, it is possible to increase a joint area. Accordingly, in order to increase the joint area, in the joint surface between the element substrate and the support member, an opening portion of the supply path which does not contribute to the joint can be made small. In addition, it is necessary to route a wire connected to the energy generating element on an element forming surface of the element substrate and in order to secure a formation area (wiring region) of the wire, an opening portion of the supply path on the element forming surface cannot be made too large. Thus, while there is a demand to increase the width of the supply path for supplying the liquid to the element substrate, there is a situation in which the opening portion of the supply path cannot be made too large.

In a configuration described in Japanese Patent Application Laid-Open No. 2011-161915, an element substrate has a multilayer structure and a substrate (second silicon substrate) joined to an ejection orifice forming member (flow path forming layer) has a supply path (second through hole) having a small opening area. Another substrate (first silicon substrate) joined to the surface of the substrate opposite to the ejection orifice forming member has a common liquid chamber (first opening) having a large opening area. The two substrates are joined to each other using an intermediate layer as a medium and the first opening and the second through hole are connected to each other.

In a configuration described in Japanese Patent Application Laid-Open No. 2011-161915, since the opening area of a second through hole is small, a joint between an ejection orifice forming member and a substrate can increase. However, since an opening area of the first opening is large, a joint between the other substrate and the support member is small. As a result, joining strength of the substrate to a support member is low and there is a possibility that the substrate may be damaged or peeled during processing, transport or joining.

SUMMARY OF THE DISCLOSURE

According to an aspect of the present disclosure, there is provided a substrate having a liquid supply path, the substrate including a first substrate which includes a first substrate through hole; and a second substrate which includes a second substrate through hole and directly or indirectly overlaps the first substrate, in which the first substrate through hole and the second substrate through hole directly or indirectly communicate with each other to form a liquid supply path, and a width D1 of an opening portion of the first substrate through hole on a surface of the first substrate closer to the second substrate, a width D2 of an opening portion of the second substrate through hole on a surface of the second substrate closer to the first substrate and a width D3 of an opening portion of the second substrate through hole on a surface of the second substrate farther from the first substrate have a relationship of $D1<D2$ and $D3<D2$.

According to another aspect of the present disclosure, there is provided a manufacturing method of a substrate including: directly or indirectly overlapping a first substrate which has a first substrate through hole and a second substrate which does not have a second substrate through hole; and introducing an etching liquid from the first substrate through hole of the first substrate directly or indirectly overlapping the second substrate so that the etching liquid reaches the second substrate, and forming the second substrate through hole directly or indirectly communicating with the first substrate through hole in the second substrate, in which the second substrate through hole is formed so that a width D1 of an opening portion of the first substrate through hole on a surface of the first substrate closer to the second substrate, a width D2 of an opening portion of the second substrate through hole on a surface of the second substrate closer to the first substrate and a width D3 of an opening portion of the second substrate through hole on a surface of the second substrate farther from the first substrate satisfy a relationship of $D1<D2$ and $D3<D2$.

Further features and aspects of the present disclosure will become apparent from the following description of example embodiments with reference to the attached drawings.

DESCRIPTION OF THE EMBODIMENTS

An aspect of the present disclosure is to provide a substrate, a liquid ejection head and a manufacturing method thereof capable of increasing joining strength of the substrate with respect to another member and increasing a supply speed of a liquid.

Hereinafter, numerous embodiments, features and aspects of the present disclosure will be described with reference to the drawings. Example embodiments of the present disclosure will be specifically described below, but these descriptions do not limit the scope of the present disclosure.

First Example Embodiment

Figure 1:
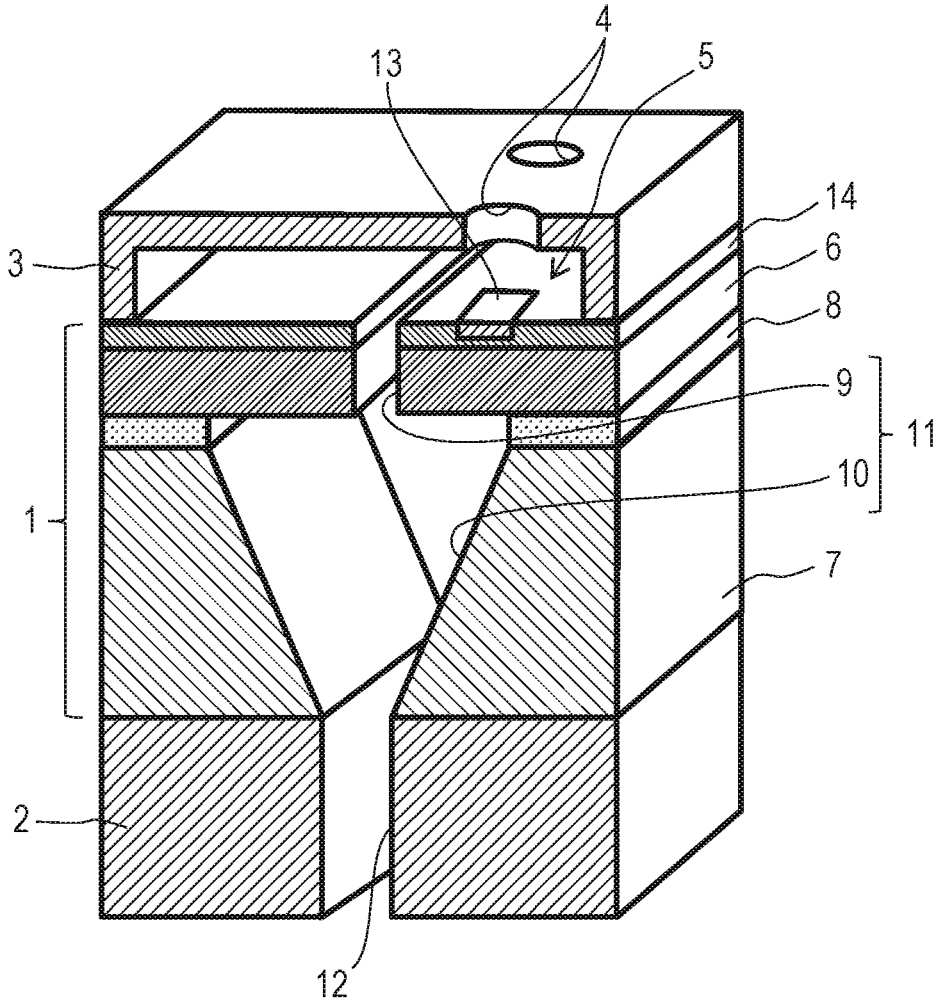
FIG. 1 is a cut-away perspective view illustrating a portion of a main portion of a liquid ejection head according to a first example embodiment of the present disclosure.

FIG. 1 illustrates a main portion of a liquid ejection head according to a first embodiment of the present disclosure. The liquid ejection head includes an element substrate (substrate) 1, a support member 2 joined to one surface of the element substrate 1 and an ejection orifice forming member 3 joined to the other surface of the element substrate 1. The ejection orifice forming member 3 has an ejection orifice 4 for ejecting the liquid to the outside of the liquid ejection head. A concave portion is formed on a surface of the ejection orifice forming member 3 which is joined to the element substrate 1. When the ejection orifice forming member 3 is joined to the element substrate 1, a pressure chamber 5 formed of a concave portion is provided between the ejection orifice forming member 3 and the element substrate 1.

Figure 2:
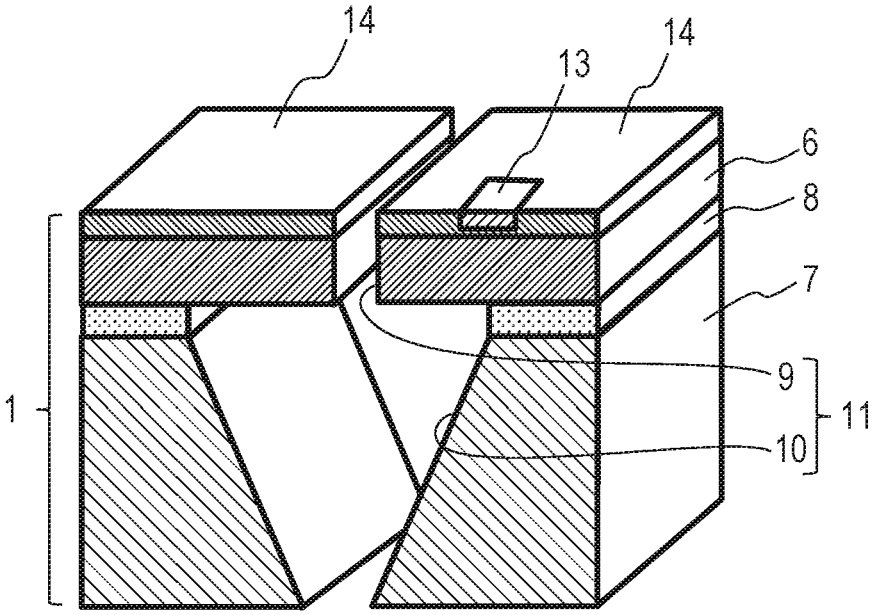
FIG. 2 is a cut-away perspective view illustrating a portion of an example substrate of the liquid ejection head illustrated in FIG. 1.

FIG. 2 illustrates an element substrate 1 of the liquid ejection head illustrated in FIG. 1. The element substrate 1 mainly has a multilayer structure in which a first substrate 6 and a second substrate 7 are bonded to each other by a substrate joining material 8. In addition, a first substrate through hole 9 penetrating the first substrate 6 and a second substrate through hole 10 penetrating the second substrate 7 communicate with each other to form a liquid supply path 11. The first substrate through hole 9 is also referred to as a supply path front end portion 9 and the second substrate through hole 10 is also referred to as a supply path rear end portion 10. As illustrated in FIG. 1, the ejection orifice forming member 3 is joined to the first substrate 6 to form the pressure chamber 5 as described above and the ejection orifice 4 and the pressure chamber 5 communicate with the supply path front end portion 9. Further, the support member 2 having a support member flow path 12 is joined to the second substrate 7 and the support member flow path 12 and the supply path rear end portion 10 communicate with each other. For example, the support member 2 is formed by resin molding of a noryl resin. Accordingly, the element substrate 1 to which the ejection orifice forming member 3 is joined is supported by the support member 2. Then, from the support member 2 toward the ejection orifice forming member 3, the support member flow path 12, the supply path rear end portion 10, the supply path front end portion 9, the pressure chamber 5 and the ejection orifice 4 are connected in this order. Accordingly, a path through which a liquid is to be ejected is configured.

An energy generating element (for example, an electrothermal conversion element) 13 and a wire connected to the energy generating element 13 are formed on a surface of the first substrate 6 which is joined to the ejection orifice forming member 3. In each drawing, a region (wiring region) 14 where a wire is formed is schematically illustrated.

In the liquid ejection head having the above-described configuration, a liquid stored in a container (not illustrated) is supplied to the pressure chamber 5 through the support member flow path 12 of the support member 2 and the liquid supply path 11 (the supply path rear end portion 10 and the supply path front end portion 9) of the element substrate 1. Moreover, when power is supplied to the energy generating element 13 through the wire formed in the wiring region 14 and the energy generating element 13 is driven, the energy generating element 13 generates energy (for example, thermal energy) and applies the energy into the liquid in the pressure chamber 5. When the energy is applied to the liquid in the pressure chamber 5, droplets are ejected from the ejection orifice 4 to the outside.

Figure 3A:
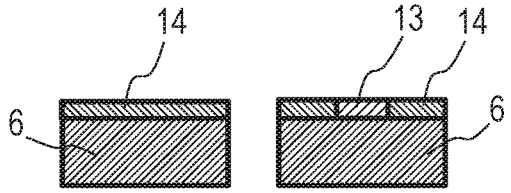
FIG. 3A is a cross-sectional view illustrating an example step of forming an energy generating element, a wiring region and a through hole in a method of manufacturing a substrate illustrated in FIG. 2.
Figure 3B:
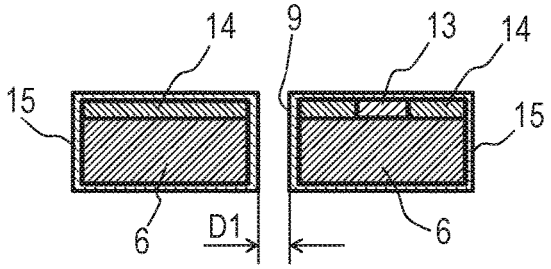
FIG. 3B is a cross-sectional view illustrating an example step of forming an etching-resistant film in the method of manufacturing a substrate illustrated in FIG. 2.

The liquid supply path 11 of the element substrate 1 of the liquid ejection head illustrated in FIGS. 1 and 2 has a dimensional relationship defined as follows. The supply path front end portion 9 which penetrates the first substrate 6 and communicates with the pressure chamber 5 has a substantially constant width over the entire length. As illustrated in FIGS. 3B and 3F, a width of an opening portion on a surface of the supply path front end portion 9 on a side of the first substrate 6 closer to the second substrate 7 is defined as D1. The supply path rear end portion 10 has a tapered shape from a surface of the second substrate 7 closer to the first substrate 6 toward a surface which is opposite to the surface of the second substrate 7 closer to the first substrate 6, is farther from the first substrate 6 and is closer to the support member 2. A width of an opening portion on the surface of the supply path rear end portion 10 of the second substrate 7 closer to the first substrate 6 is defined as D2, and a width of an opening portion of a surface of the supply path rear end portion 10 which is opposite to the surface of the supply path rear end portion 10 closer to the first substrate 6, is farther from the first substrate 6 and is closer to the support member 2 is defined as D3. In this case, $D1<D2$ and $D3<D2$ are satisfied. According to this configuration, the width D2 of the portion where the supply path rear end portion 10 communicates with the supply path front end portion 9 is large. Therefore, a relatively large liquid supply path 11 is formed. If the liquid supply path is small, when a liquid is ejected and the liquid in the pressure chamber runs short, in order to refill the pressure chamber with the liquid, it is necessary to draw the liquid from the container via the liquid supply path and the support member flow path, and in some cases, the drawing of the liquid cannot be efficiently performed in a short time. Meanwhile, in the present embodiment, the width of the communicating portion of the supply path rear end portion 10 with the supply path front end portion 9 and the width of the vicinity thereof are wide. Accordingly, the liquid supply path 11 is large and an amount of liquid which is can be immediately supplied to the pressure chamber 5 is large. Therefore, when the liquid is ejected and the liquid in the pressure chamber 5 runs short, the pressure chamber 5 can be efficiently filled with the liquid again in a short time. As a result, it is possible to increase a speed and frequency of the liquid ejection.

In the present embodiment, the width D3 of the portion where the supply path rear end portion 10 communicates with the support member flow path 12 is small. Accordingly, an area of a joint between the second substrate 7 and the support member 2 increases and a joining strength can increase. Similarly, since the width D1 of the supply path front end portion 9 is small, an area of a joint between the first substrate 6 and the ejection orifice forming member 3 increases and a joining strength increases. As a result, the joining strength of the element substrate 1 to other members (the support member 2 and the ejection orifice forming member 3) is high. Accordingly, peeling or damages can be suppressed and leakage and mixing of the liquid supplied to the element substrate 1 can be suppressed. Further, since the width D1 of the supply path front end portion 9 is small, the wiring region 14 can be widened in the first substrate 6 and it is possible to dispose a plurality of energy generating elements 13 at high density and route the wire.

The liquid supply path 11 illustrated in FIGS. 1 and 2 has an elongated planar shape and a dimension of the liquid supply path 11 in a longitudinal direction is substantially constant over the entire liquid supply path 11. Meanwhile, dimensions of the supply path rear end portion 10 and the supply path front end portion 9 are changed in a direction orthogonal to the longitudinal direction, and here, the dimension in this direction is referred to as a "width". That is, the dimension in the direction orthogonal to the longitudinal direction in the planar shape is the "width". However, in a case where the planar shape of the liquid supply path 11 is circular, a diameter of the liquid supply path 11 may be referred to as a "width".

A method of manufacturing the element substrate 1 according to the present embodiment will be described. First, as illustrated in FIG. 3A, the energy generating element (for example, an electrothermal conversion element) 13 is formed on one surface of the first substrate 6 made of silicon and the wire connected to the energy generating element 13 is formed in the wiring region 14. A positive resist (not illustrated) is applied to a surface (hereinafter, referred to as an "element forming surface") on which the energy generating element 13 is formed and which includes the wiring region 14, exposure and development are performed and dry etching using plasma is performed to form the through hole. Then, as illustrated in FIG. 3B, TiO (titanium monoxide) is formed on the entire surface of the first substrate 6 on which the supply path front end portion 9 is formed by using an atomic layer deposition method to form an etching-resistant film (resistant crystal anisotropic etching film, resistant silicon etching film) 15. In FIGS. 1 and 2, the resistant crystal anisotropic etching film 15 is not illustrated. In this way, the supply path front end portion 9 communicating with the ejection orifice 4 and the pressure chamber 5 illustrated in FIG. 1 is formed on the first substrate 6. The width of the opening portion of the supply path front end portion 9 which opens on the surface of the first substrate 6 opposite to the element forming surface is defined as D1. The formation of the supply path front end portion 9 may be performed after a joining step to the second substrate 7 described later.

Figure 3C:
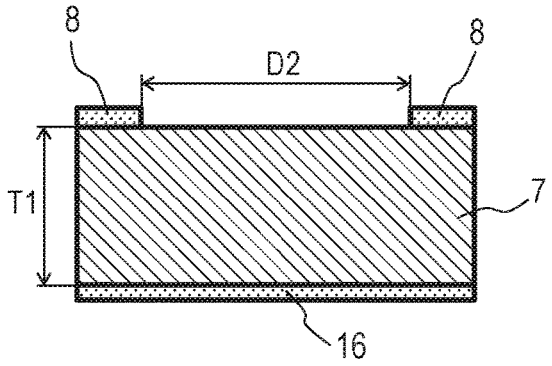
FIG. 3C is a cross-sectional view illustrating an example step of forming a substrate joining material on one surface of a second substrate and a resistant crystal anisotropic etching film on the other surface of the second substrate in the method of manufacturing a substrate illustrated in FIG. 2.

Meanwhile, as illustrated in FIG. 3C, a substrate joining material 8 is applied to one surface of a second substrate 7 made of single crystal silicon having a crystal orientation (100). The substrate joining material 8 also serves as a crystal anisotropic etching mask and is made of a resin material, for example, a polyamide resin or SiO. A positive resist (not illustrated) is applied to a surface (hereinafter, referred to as a "joining material forming surface") to which the substrate joining material 8 is applied and exposure and development are performed. In a case where the substrate joining material 8 is a polyamide resin, dry etching is performed and in a case where the substrate joining material 8 is SiO, etching is performed using BHF (buffered hydrofluoric acid) to pattern the substrate joining material 8. However, the formation and patterning of the substrate joining material 8 may be performed on the surface of the first substrate 6 opposite to the element forming surface. An etching-resistant film (resistant crystal anisotropic etching film, resistant silicon etching film) 16 is applied to the surface of the second substrate 7 opposite to the joining material forming surface. The resistant crystal anisotropic etching film 16 may be a polyamide resin film or a SiO film.

Figure 3D:
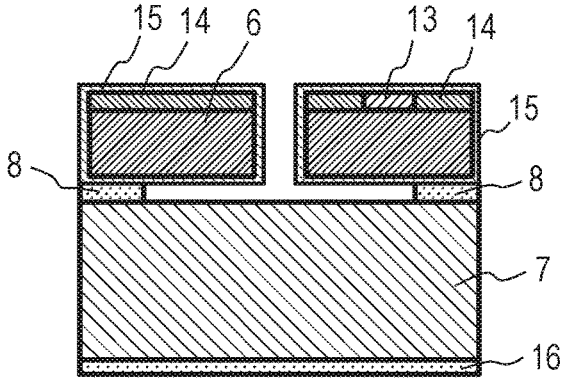
FIG. 3D is a cross-sectional view illustrating an example step of bonding a first substrate and the second substrate in the method of manufacturing the substrate illustrated in FIG. 2.

The first substrate 6 on which the resistant crystal anisotropic etching film 15 and the supply path front end portion 9 are formed as illustrated in FIG. 3B and the second substrate 7 on which the substrate joining material 8 and the resistant crystal anisotropic etching film 16 are formed as illustrated in FIG. 3C overlap each other. In this case, as illustrated in FIG. 3D, the surface of the first substrate 6 opposite to the element forming surface abuts on the joining material forming surface of the second substrate 7. Then, the first substrate 6 and the second substrate 7 are joined to each other by the substrate joining material 8. In a case where the substrate joining material 8 is a polyamide resin, the first substrate 6 and the second substrate 7 are bonded to each other while being heated and pressed. In a case where the substrate joining material 8 is SiO, the first substrate 6 and the second substrate 7 are subjected to plasma processing to be bonded to each other.

Figure 3E:
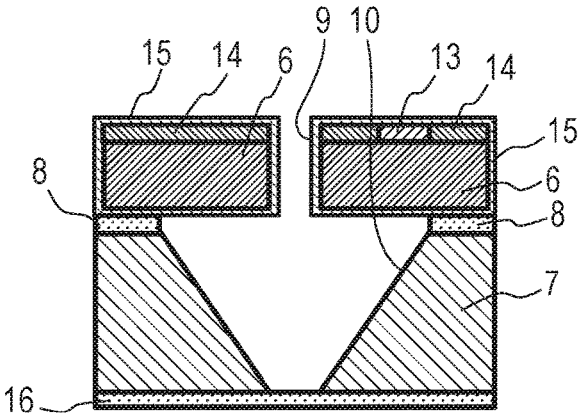
FIG. 3E is a cross-sectional view illustrating an example step of forming a supply path rear end portion by crystal anisotropic etching in the method of manufacturing the substrate illustrated in FIG. 2.
Figure 3F:
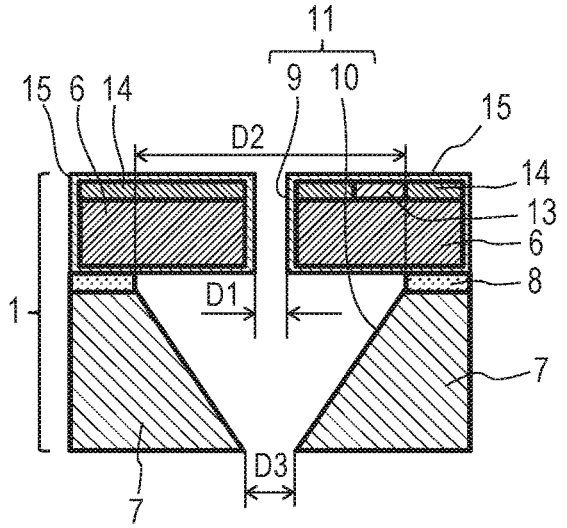
FIG. 3F is a cross-sectional view illustrating an example step of forming an opening portion of the supply path rear end portion by crystal anisotropic etching in the method of manufacturing the substrate illustrated in FIG. 2.

After the first substrate 6 and the second substrate 7 are joined to each other as described above, a silicon etching agent is injected from the supply path front end portion 9 provided on the first substrate 6. For example, the silicon etching agent may be potassium hydroxide (KOH) or tetramethylammonium hydroxide (TMAH). The silicon etching agent does not etch the first substrate 6 which is covered with the resistant crystal anisotropic etching film 15 and etches a portion of the second substrate 7 which is not covered with the substrate joining material 8 functioning as a mask. When single crystal silicon having a crystal orientation (100) constituting the second substrate 7 is subjected to crystal anisotropic etching, the second substrate 7 is etched at a predetermined angle. As a result, as illustrated in FIG. 3E, a tapered hole portion is formed from the first substrate 6 side (joining material forming surface) toward the surface on which the resistant crystal anisotropic etching film 16 is formed. This hole portion is the supply path rear end portion 10 communicating with the supply path front end portion 9 of the first substrate 6. In this case, a starting position of the crystal anisotropic etching of the second substrate 7, that is, the width of the portion which not covered with the substrate joining material 8 functioning as a mask substantially equal to the width D2 of the opening portion in the joining material forming surface of the supply path rear end portion 10. As described above, the formation of the supply path rear end portion 10 is not limited to the method of completing the supply path rear end portion 10 penetrating the second substrate 7 by the crystal anisotropic etching. That is, only a portion of the supply path rear end portion 10 may be formed by the crystal anisotropic etching and the crystal anisotropic etching may be terminated without penetrating the second substrate 7. In that case, dry etching, grinding or polishing may be performed on the opposite side of the joining material forming surface of the second substrate 7 in the later step so that the supply path rear end portion 10 penetrating the second substrate 7 is completed.

As illustrated in FIG. 3F, the resistant crystal anisotropic etching film 16 on the surface opposite to the joining material forming surface of the second substrate 7 is removed. In a case where the resistant crystal anisotropic etching film 16 is made of a polyamide resin, the resistant crystal anisotropic etching film 16 is removed by dry etching and in a case where the resistant crystal anisotropic etching film 16 is SiO, the resistant crystal anisotropic etching film 16 is removed by etching using BHF. The width of the opening portion of the supply path rear end portion 10 on the surface, which is exposed after the resistant crystal anisotropic etching film 16 is removed and is opposite to the joining material forming surface, is defined as D3.

Thus, the element substrate 1 which is a laminate of the first substrate 6 and the second substrate 7 is formed (refer to FIGS. 2 and 3F). The element substrate 1 includes the liquid supply path 11 which is formed by connecting the supply path front end portion 9 penetrating the first substrate 6 and the supply path rear end portion 10 penetrating the second substrate 7 to each other. The width D1 of the surface of the supply path front end portion 9 of the first substrate 6 closer to the second substrate 7, the width D2 of the opening portion on the joining material forming surface of the supply path rear end portion 10 of the second substrate 7, and the width D3 of the opening portion on the surface opposite to the joining material forming surface have a relationship of D1<D2 and D3<D2. A center of the supply path front end portion 9 of the first substrate 6 and a center of the supply path rear end portion 10 of the second substrate 7 may coincide with each other or may not coincide with each other.

The ejection orifice forming member 3 is laminated and patterned on the element forming surface side of the first substrate 6 of the element substrate 1. Accordingly, the pressure chamber 5 communicating with the supply path front end portion 9 and the ejection orifice 4 which is open to the outside from the pressure chamber 5 are formed. Further, the support member 2 is joined to the side opposite to the joining material forming surface of the second substrate 7 of the element substrate 1. Accordingly, the liquid ejection head illustrated in FIG. 1 is configured.

In the liquid ejection head of the present embodiment, as described above, the widths D1 to D3 of the respective portions of the supply path front end portion 9 and the supply path rear end portion 10 have the relationship of D1<D2 and D3<D2. According to this configuration, the strength of the element substrate 1 does not decrease and the formation region of the energy generating element 13 and the wiring region 14 are secured. Moreover, the liquid supply path 11 inside the element substrate 1 is widened and a wide joint area between the element substrate 1, the support member 2 and the ejection orifice forming member 3 can be secured. In the manufacturing method of the present embodiment, the second substrate 7 is joined to the first substrate 6 before the supply path rear end portion 10 is formed and the etching agent is injected from the supply path front end portion 9 formed in the first substrate 6. With this etching agent, the supply path rear end portion 10 can be formed in the second substrate 7 using the substrate joining material 8 as a mask. Thus, the element substrate 1 having the supply path front end portion 9 and the supply path rear end portion 10 having the above-described dimensional relationship can be easily formed without damaging the first and second substrates 6 and 7.

If the first substrate 6 having the supply path front end portion 9 in advance and the second substrate 7 having the supply path rear end portion 10 in advance are bonded to each other, particularly the width D2 of the opening portion on the surface of the supply path rear end portion 10 closer to the first substrate 6 is large, it is difficult to obtain a sufficiently strong joining strength. However, in the present embodiment, after the second substrate 7 in which the supply path rear end portion 10 is not formed is joined to the first substrate 6 to realize a stable and strong joining state, the supply path rear end portion 10 is formed. Therefore, in the joint between the second substrate 7 and the first substrate 6, it is possible to achieve both the wide opening portion D2 of the supply path rear end portion 10 and the strong joint.

The supply path front end portion 9 of the first substrate 6 may be formed after a step of joining the first substrate 6 and the second substrate 7 to each other. Since the supply path front end portion 9 is side-etched when the etching agent is injected from the supply path front end portion 9, dimensions (particularly the width D1) of the supply path front end portion 9 are set considering an amount of side etching in advance.

Example 1

A more specific example will be described based on the above-described first embodiment of the present disclosure. As illustrated in FIGS. 3A and 3B, an electrothermal conversion element which is an example of the energy generating element 13, the wire in the wiring region 14 and a through hole which penetrates the first substrate 6 to constitute the supply path front end portion 9 are formed in the first substrate 6 made of silicon. Then, a resistant crystal anisotropic etching film 15 which covers the entire surface of the first substrate 6 and also serves as an ink-resistant film is formed. The supply path front end portion 9 formed in this manner has a substantially constant width over the entire length and the width D1 of the supply path front end portion 9 is 20 μm.

As illustrated in FIG. 3C, silicon having a crystal orientation (100) is cut out to form a second substrate 7 having a thickness T1=625 μm. The substrate joining material 8 is applied to one surface of the second substrate 7 and a SiO film is formed as the resistant crystal anisotropic etching film 16 on the other surface. The substrate joining material 8 of the present example is a polyamide resin film having a thickness of 2.0 μm and has a sufficient thickness so that a silicon etching agent injected after the substrate joining material 8 is joined to the first substrate 6 easily enters. However, the substrate joining material 8 may be a SiO film having a thickness of about 0.5 μm. Exposure, development and etching are performed on the substrate joining material 8 so that the opening portion having the width D2 larger than the width D1 of the opening portion of the supply path front end portion 9 is formed.

As illustrated in FIG. 3D, the first substrate 6 and the second substrate 7 overlap each other and are heated and pressurized, specifically, a state where a pressure of 5 kN is applied to the first substrate 6 and the second substrate 7 while heating the first substrate 6 and the second substrate 7 at 250° C. is maintained for 60 minutes. Accordingly, the first substrate 6 and the second substrate 7 are joined to each other. Then, a silicon etching agent is injected from the supply path front end portion 9 of the first substrate 6 and crystal anisotropic etching is performed using the substrate joining material 8 as a mask. Accordingly, the supply path rear end portion 10 is formed as illustrated in FIG. 3E. In a case where the second substrate 7 is silicon having a crystal orientation (100), the second substrate 7 is etched at an angle of 54.7°, and thus, $D2=T1/\tan 54.7°\times 2+D3$. In the specific example, as described above, D1=20 μm, D2=1085 μm and D3=200 μm, and the relationship of $D1<D3<D2$ holds. Thereafter, as illustrated in FIG. 3F, the resistant crystal anisotropic etching film 16 of the second substrate 7 is removed by BHF.

According to this manufacturing method, after the formation region of the energy generating element 13 and the wiring region 14 are sufficiently secured without damaging the element substrate 1 including the first substrate 6 and the second substrate 7, the supply path front end portion 9 and the supply path rear end portion 10 can be formed. Then, the element substrate 1 can be formed, in which the width D2 of the opening portion of the supply path rear end portion 10 inside the element substrate 1 on the joint surface between the first substrate 6 and the second substrate 7 is wide and the width D3 of the opening portion on the joint surface between the element substrate 1 and the support member 2 is small.

Example 2

Figure 4A:
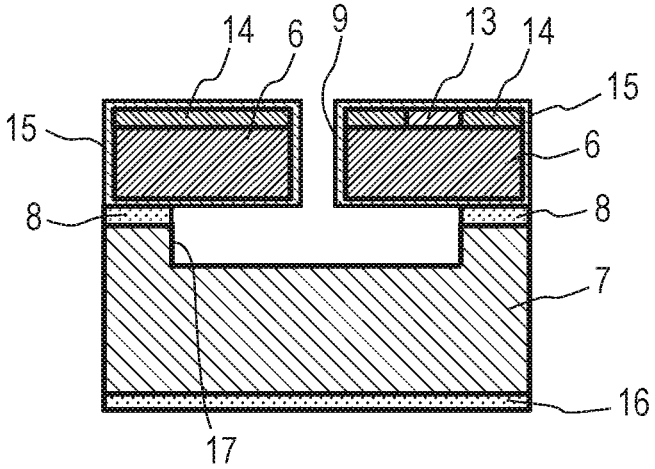
FIG. 4A is a cross-sectional view illustrating Example 2 of a method of manufacturing a substrate according to the present disclosure and relates to a concave portion formed by etching the second substrate using the substrate joining material as a mask.
Figure 4B:
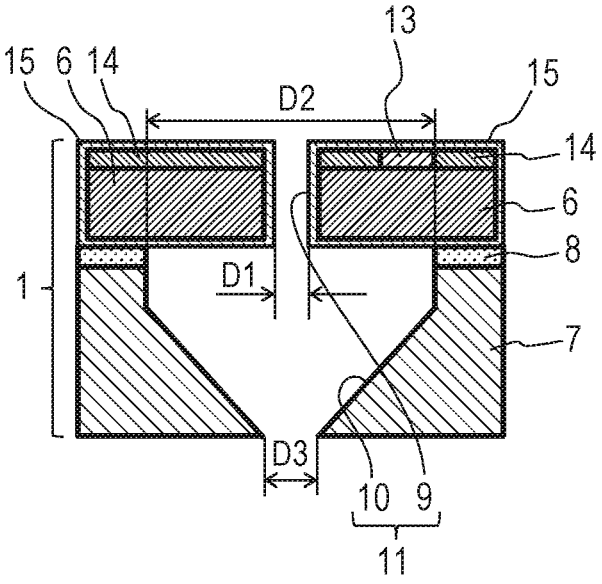
FIG. 4B is a cross-sectional view illustrating Example 2 of the method of manufacturing the substrate according to the present disclosure and relates to a substrate including the supply path rear end portion formed by etching the second substrate.

Example 2 of the element substrate 1 based on the above-described first embodiment of the present disclosure will be described with reference to FIGS. 4A, 4B, 5A, 5B, 6A and 6B. Descriptions of portions common to Example 1 are omitted. According to the present example, a silicon etching agent can be easily introduced when the supply path rear end portion 10 is formed in the second substrate 7. Specifically, as illustrated in FIG. 4A, the substrate joining material 8 is formed on the surface of the second substrate 7 before is joined to the first substrate 6 and is closer to the first substrate 6 and the second substrate 7 is etched by about 10 μm using the substrate joining material 8 as a mask. As a result, a concave portion 17 is formed in the second substrate 7 by about 10 μm from the joining material forming surface. In this state, the first substrate 6 and the second substrate 7 are joined to each other and a silicon etching agent is injected from the supply path front end portion 9 of the first substrate 6. First, the injected silicon etching agent is stored in the concave portion 17 and then gradually erodes the second substrate 7 to form the supply path rear end portion 10 as illustrated in FIG. 4B.

Figure 5A:
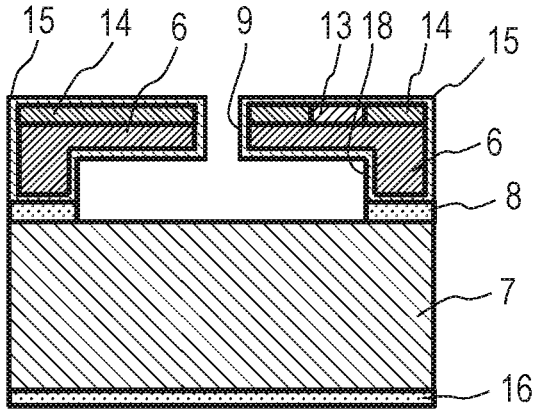
FIG. 5A is a cross-sectional view illustrating a modification example of the method of manufacturing a substrate illustrated in FIG. 4A.
Figure 5B:
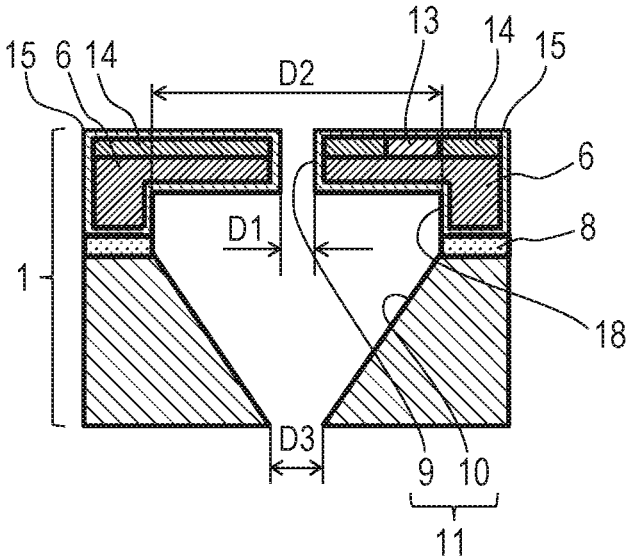
FIG. 5B is a cross-sectional view illustrating a modification example of the method of manufacturing a substrate illustrated in FIG. 4B.

FIGS. 5A and 5B illustrate a modification example of the present example. In the example illustrated in FIGS. 4A and 4B, the concave portion 17 is formed in the second substrate 7 along the opening portion of the substrate joining material 8. However, in the present modification example, as illustrated in FIG. 5A, a portion of the first substrate 6 facing the opening portion of the substrate joining material 8 is etched by about 10 μm. In this modification example, the substrate joining material 8 can be formed on the first substrate 6 instead of the second substrate 7. In addition, in the present modification example, a space 18 formed by etching the first substrate 6 is a storage which is filled with the silicon etching agent injected from the supply path front end portion 9 similarly to the concave portion 17 of the example illustrated in FIGS. 4A and 4B. Then, the second substrate 7 is etched to form the supply path rear end portion 10 as illustrated in FIG. 5B.

In any of the examples described in FIGS. 4A, 4B, 5A and 5B, the silicon etching agent injected from the supply path front end portion 9 is temporarily stored inside the concave portion 17 or the space 18 and does not diffuse outside the concave portion 17 or the space 18. Therefore, formation accuracy of the supply path rear end portion 10 by etching is favorable, an amount of silicon etching agent used can be reduced and working efficiency is improved.

Figure 6A:
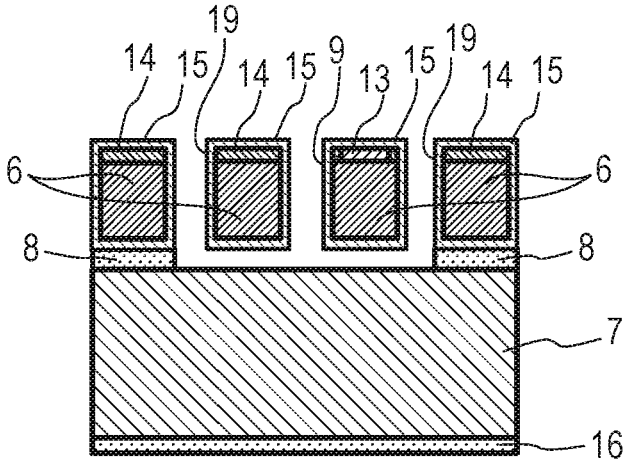
FIG. 6A is a cross-sectional view illustrating another modification example of the method of manufacturing a substrate illustrated in FIG. 4A.
Figure 6B:
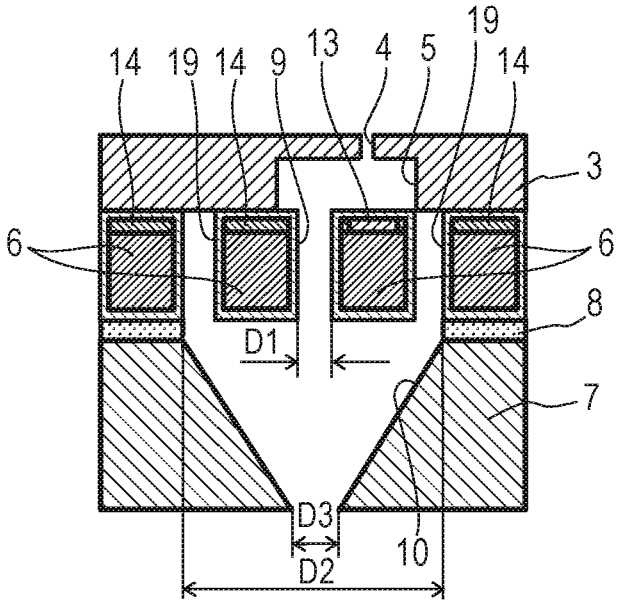
FIG. 6B is a cross-sectional view illustrating another modification example of the method of manufacturing a substrate illustrated in FIG. 4B.

In another modification example illustrated in FIGS. 6A and 6B, through holes 19 penetrating the first substrate 6 are respectively formed at positions of the supply path rear end portion 10 facing both ends of the width D2 of the opening portion at the joint surface between the second substrate 7 and the first substrate 6. In one example, a width of the through hole 19 is 50 μm. According to this configuration, after the first substrate 6 and the second substrate 7 are joined to each other as illustrated in FIG. 6A, a silicon etching liquid can be injected from the supply path front end portion 9 and the through holes 19 penetrating the first substrate 6. Therefore, efficiency of the injection of the silicon etching liquid is high and an operation time for forming the supply path rear end portion 10 can be reduced. After the element substrate 1 having the liquid supply path 11 is formed, as illustrated in FIG. 6B, the ejection orifice forming member 3 is joined to the element substrate 1 and the through holes 19 are closed by the ejection orifice forming member 3. Only the supply path front end portion 9 that is joined to the supply path rear end portion 10 and forms the liquid supply path 11 communicates with the pressure chamber 5 and the ejection orifice 4. In the liquid ejection head in a completed state, a supply of the liquid to the pressure chamber 5 is performed only from the supply path front end portion 9 and the through holes 19 do not participate in the supply or the ejection of the liquid. That is, by forming the through holes 19, performance of the supply and ejection of the liquid does not vary.

In all of Example 2 and modification examples thereof illustrated in FIGS. 4A, 4B, 5A, 5B, 6A and 6B, the widths D1 to D3 of the respective portions of the supply path front end portion 9 and the supply path rear end portion 10 have the relationship of $D1<D2$ and $D3<D2$.

Example 3

Figure 7A:
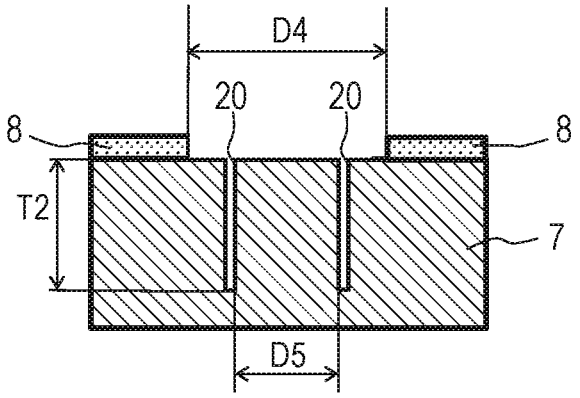
FIG. 7A is a cross-sectional view illustrating Example 3 of the method of manufacturing the substrate according to the present disclosure and relates to a concave portion formed by etching the second substrate using the substrate joining material as a mask.
Figure 7B:
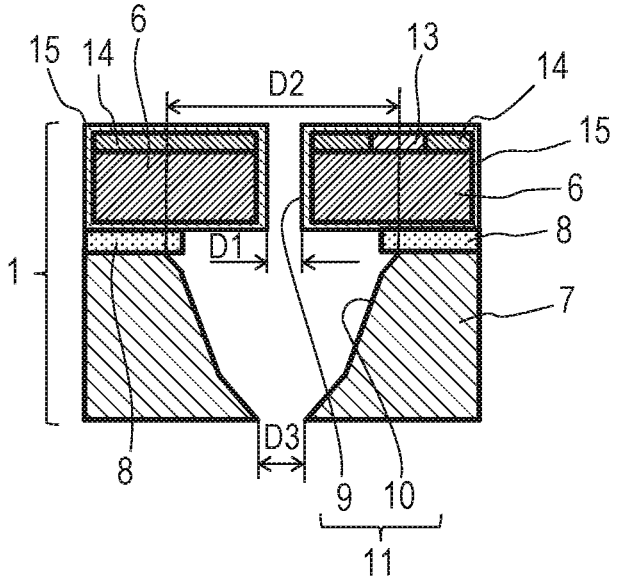
FIG. 7B is a cross-sectional view illustrating Example 3 of the method of manufacturing the substrate according to the present disclosure and relates to a substrate including a supply path rear end portion formed by etching the second substrate.

Example 3 of the element substrate according to the first embodiment of the present disclosure will be described with reference to FIGS. 7A and 7B. Descriptions of portions common to Examples 1 and 2 are omitted. As illustrated in FIG. 7A, in the present example, a plurality of leading holes 20 is formed in the second substrate 7 before the second substrate 2 is joined to the first substrate 6. The leading holes 20 do not penetrate the second substrate 7 and are formed at positions inside the supply path rear end portion 10 when the supply path rear end portion 10 is formed. In one example, the width D4 of the opening portion of the substrate joining material 8 which functions as a mask formed on the second substrate 7 is 500 μm. This width D4 is similar to the width D2 of the opening portion on the surface of the supply path rear end portion 10 which is to be formed later and is closer to the first substrate 6. Two leading holes 20 are symmetrically disposed about a center position of the opening portion of the substrate joining material 8 in a width D4 direction. A distance D5 between the leading holes 20 is 342 μm. A length T2 of the leading hole 20 in a longitudinal direction, that is, a depth of the leading hole 20 extending in a thickness direction of the second substrate 7 is 525 μm. In this configuration, when the first substrate 6 and the second substrate 7 are joined to each other and then a silicon etching agent is injected from the supply path front end portion 9, first, the silicon etching agent penetrates the leading hole 20 and the silicon etching is performed about the leading hole 20. Accordingly, the supply path rear end portion 10 is formed as illustrated in FIG. 7B. According to the present example, a size of the element substrate 1 can be reduced.

Moreover, in the present example, the widths D1 to D3 of the respective portions of the supply path front end portion 9 and the supply path rear end portion 10 have a relationship of D1<D2 and D3<D2.

Example 4

Figure 8:
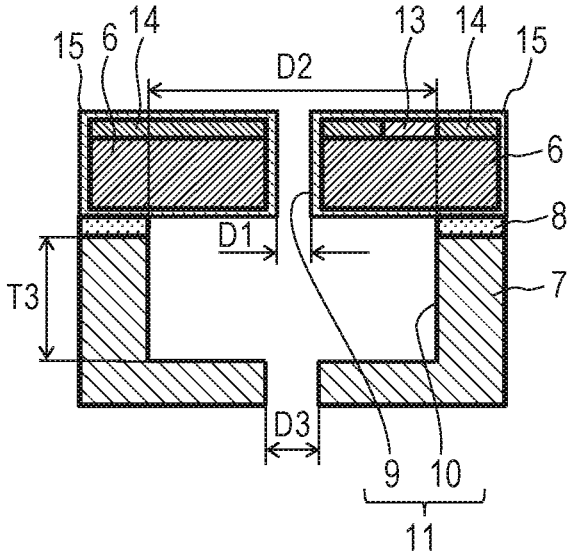
FIG. 8 is a cross-sectional view illustrating Example 4 of the method of manufacturing a substrate according to the present disclosure.

Example 4 of the element substrate based on the first embodiment of the present disclosure will be described with reference to FIG. 8. Descriptions of portions common to Examples 1 to 3 are omitted. In the present example, the second substrate 7 is formed of silicon having a crystal orientation (110) and is joined to the first substrate 6. Then, when a silicon etching agent is injected from the supply path front end portion 9, the etching proceeds substantially linearly along a thickness direction of the second substrate 7. This silicon etching is completed before penetrating the second substrate 7. Then, dry etching is performed on the surface of the second substrate 7 farther from the first substrate 6, that is, the dry etching is performed on a portion which is not eroded by the etching and the supply path rear end portion 10 penetrating the second substrate 7 is formed. In the supply path rear end portion 10 formed in this manner, compared to a width of the portion formed by the silicon etching from a surface closer to the first substrate 6, a width of the portion formed by the dry etching from a surface opposite to the surface closer to the first substrate 6 is smaller. Specifically, the width D2 of the portion of the supply path rear end portion 10 formed by the silicon etching is 727 μm and the width D3 of the portion formed by dry etching is 200 μm. A length T3 of the portion of the supply path rear end portion 10 formed by silicon etching in a longitudinal direction, that is, a depth extending in a thickness direction of the second substrate 7 is 525 μm. Moreover, in the present example, the widths D1 to D3 of the respective portions of the supply path front end portion 9 and the supply path rear end portion 10 have a relationship of D1<D2 and D3<D2. According to the present example, the size of the element substrate 1 can be reduced in size while a large volume of the liquid supply path 11 is realized.

Second Example Embodiment

Next, a second embodiment of the present disclosure will be described. Descriptions of portions common to the first embodiment are omitted. In the above-described first embodiment, the first substrate 6 joined to the ejection orifice forming member 3 and the second substrate 7 joined to the support member 2 are directly joined to each other and the element substrate 1 having a substantially two-layer structure is configured. Meanwhile, in the present embodiment, a third substrate 21 is interposed between a first substrate 6 joined to an ejection orifice forming member 3 and a second substrate 7 joined to a support member 2. Accordingly, an element substrate 1 has a substantially three-layer structure. The third substrate 21 includes a third substrate through hole 22. The third substrate through hole 22 is also referred to as a supply path intermediate portion 22.

Figure 9:
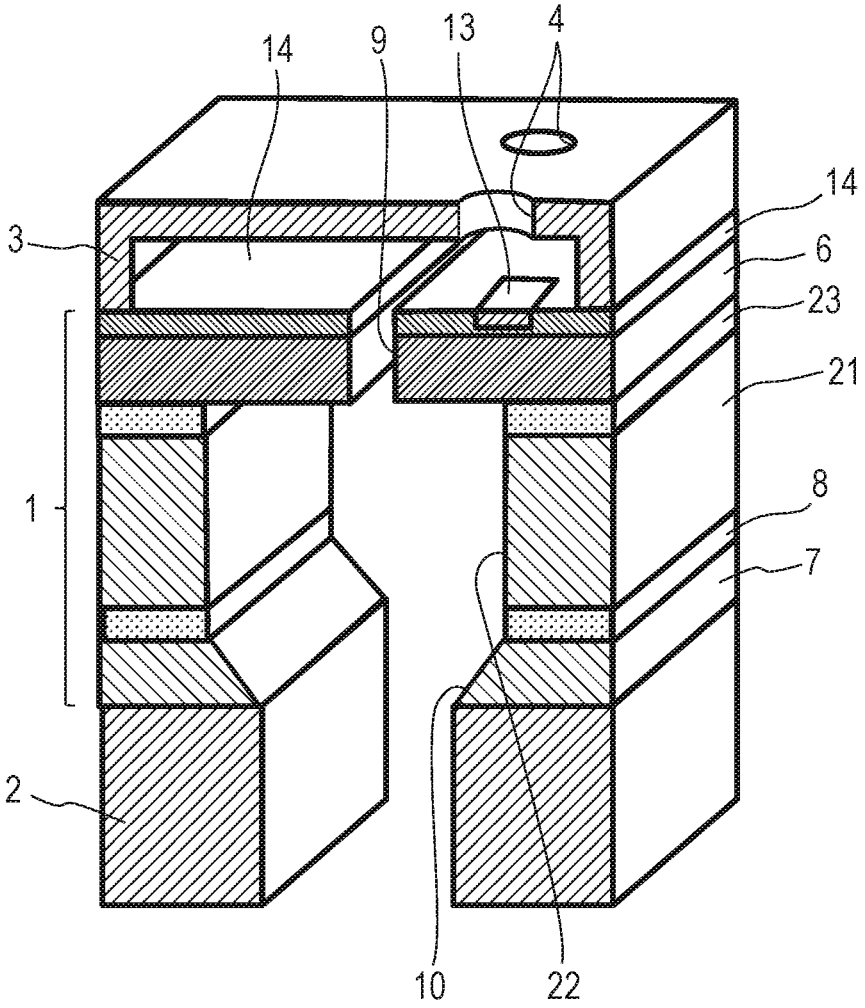
FIG. 9 is a cut-way perspective view illustrating a portion of a main portion of a liquid ejection head according to a second example embodiment of the present disclosure.
Figure 10:
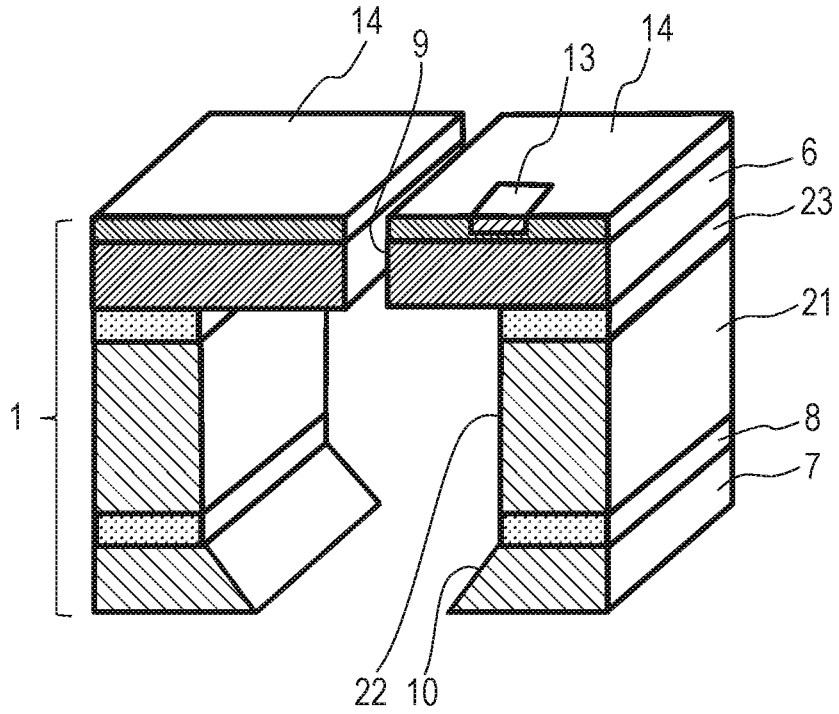
FIG. 10 is a cut-away perspective view illustrating an example portion of a substrate of the liquid ejection head illustrated in FIG. 9.

As illustrated in FIG. 9, in a liquid ejection head of the present embodiment, the ejection orifice forming member 3 is joined to one surface of the element substrate 1 mainly including the first substrate 6, the third substrate 21 and the second substrate 7 and the support member 2 is joined to the other surface of the element substrate 1. As illustrated in FIG. 10, in the element substrate 1, the first substrate 6 having a narrow supply path front end portion 9 and a second substrate 7 having a tapered supply path rear end portion 10 are indirectly joined to each other via the third substrate 21 having the supply path intermediate portion 22 having a substantially constant width.

Figure 11A:
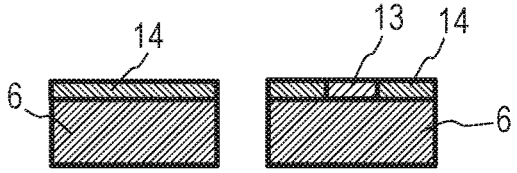
FIG. 11A is a cross-sectional view illustrating an example step of forming an energy generating element, a wiring region and a through hole in the method of manufacturing a substrate illustrated in FIG. 10.
Figure 11B:
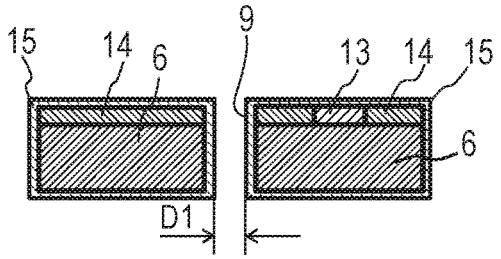
FIG. 11B is a cross-sectional view illustrating an example step of forming an etching-resistant film in the method of manufacturing the substrate illustrated in FIG. 10.

Similarly to the first embodiment, the first substrate 6 includes the supply path front end portion 9 which penetrates the first substrate 6 and communicates with a pressure chamber 5. The supply path front end portion 9 has a substantially constant width over the entire length and as illustrated in FIG. 11G, a width of an opening portion on a surface closer to the second substrate 7 is D1. The second substrate 7 has the supply path rear end portion 10 which is tapered from a surface closer to the first substrate 6 toward a surface which is opposite to the surface closer to the first substrate 6 and is closer to the support member 2. A width of an opening portion on the surface of the supply path rear end portion 10 of the second substrate 7 closer to the first substrate 6 is defined as D2 and a width of an opening portion of a surface of the supply path rear end portion 10 which is opposite to the surface of the supply path rear end portion 10 closer to the first substrate 6, is farther from the first substrate 6 and is closer to the support member 2 is defined as D3. The third substrate 21 located between the first substrate 6 and the second substrate 7 includes the supply path intermediate portion 22 which connects the supply path front end portion 9 and the supply path rear end portion 10 to each other. The supply path intermediate portion 22 has a substantially constant width over the entire length and a width of the supply path intermediate portion 22 is substantially equal to the width D2 of the opening portion on the surface of the supply path rear end portion 10 of the second substrate 7 closer to the first substrate 6. The widths D1, D2 and D3 have the relationship of D1<D2 and D3<D2. As a result, the width D2 of the opening portion on the surface of the supply path rear end portion 10 of the second substrate 7 closer to the first substrate 6 and the entire width of the supply path intermediate portion 22 are wide. Accordingly, a large liquid supply path 11 are formed. Therefore, an amount of liquid which is can be immediately supplied to the pressure chamber 5 is large, the pressure chamber 5 can be efficiently filled with the liquid in a short time and it is possible to increase a speed and frequency of the liquid ejection. In particular, in the present embodiment, compared to the first embodiment, the number of components increases. However, a ratio of a portion (mainly the supply path intermediate portion 22) having a wide width in the liquid supply path 11 increases, which greatly contributes to a higher speed and a higher frequency of the liquid ejection.

Moreover, the width D3 of the supply path rear end portion 10 is small. Accordingly, an area of a joint between the second substrate 7 and the support member 2 can increase and a joining strength can increase. Since the width D1 of the supply path front end portion 9 is small, an area of a joint between the first substrate 6 and the ejection orifice forming member 3 increases and a joining strength increases. Peeling or damages of the element substrate 1 from the support member 2 and the ejection orifice forming member 3 can be suppressed and leakage and mixing of the liquid supplied to the element substrate 1 can be suppressed. Further, since the width D1 of the supply path front end portion 9 is small, the wiring region 14 can be widened in the first substrate 6 and it is possible to dispose a plurality of energy generating elements 13 at high density and route the wire.

As described above, the same effects as those of the first embodiment can be obtained in the present embodiment. In particular, there is a great effect that the relatively large liquid supply path 11 can be formed to increase the speed and frequency of the liquid ejection.

The method of manufacturing the element substrate according to the present embodiment will be described below. As illustrated in FIG. 11A, similarly to the first embodiment, the energy generating element (for example, an electrothermal conversion element) 13, the wiring region 14 and the through hole constituting the supply path front end portion 9 are formed in the first substrate 6 made of silicon. Next, as illustrated in FIG. 11B, a resistant crystal anisotropic etching film 15 made of TiO is formed on the entire surface of the first substrate 6 in which the supply path front end portion 9 is formed. In FIGS. 9 and 10, the resistant crystal anisotropic etching film 15 is not illustrated. In this way, the supply path front end portion 9 is formed and the width of the opening portion of the supply path front end portion 9 on the surface (the surface close to the second substrate 7) opposite to the element forming surface of the first substrate 6 is defined as D1.

Figure 11C:
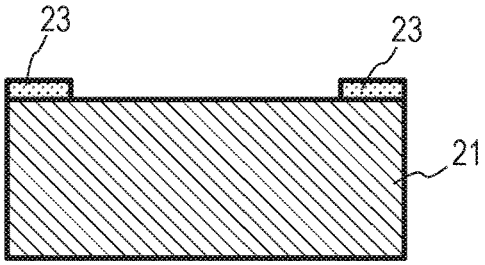
FIG. 11C is a cross-sectional view illustrating an example step of etching one surface of a third substrate and patterning a substrate joining material in the method of manufacturing a substrate illustrated in FIG. 10.

As illustrated in FIG. 11C, a substrate joining material 23 is applied to one surface of the third substrate 21 of which both surfaces are polished and which is made of single crystal silicon having a crystal orientation (110) and has a thickness of 500 μm. The substrate joining material 23 also serves as a crystal anisotropic etching mask and is made of a resin material, for example, a polyamide resin or SiO. A positive resist (not illustrated) is applied to a surface (hereinafter, referred to as a "joining material forming surface") to which the substrate joining material 23 is applied and exposure and development are performed. In a case where the substrate joining material 23 is a polyamide resin, dry etching is performed and in a case where the substrate joining material 23 is SiO, etching is performed using BHF to pattern the substrate joining material 23. However, the formation and patterning of the substrate joining material 23 may be performed on the surface of the first substrate 6 opposite to the element forming surface.

Figure 11D:
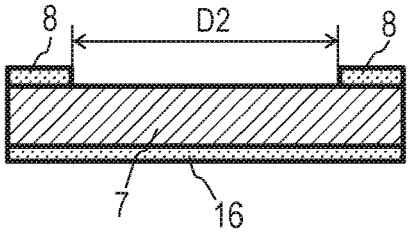
FIG. 11D is a cross-sectional view illustrating an example step of forming the substrate joining material on one surface of the second substrate and a resistant crystal anisotropic etching film on the other surface of the second substrate in the method of manufacturing a substrate illustrated in FIG. 10.

As illustrated in FIG. 11D, similarly to the first embodiment, a substrate joining material 8 is applied to one surface of the second substrate 7 made of single crystal silicon having a crystal orientation (100) and a resistant crystal anisotropic etching film 16 is applied to the other surface of the second substrate 7. However, the formation and patterning of the substrate joining material 8 may be performed on the surface of the third substrate 21 opposite to the surface on which the substrate joining material 23 is formed. The substrate joining material 8 and the substrate joining material 23 may be the same.

Figure 11E:
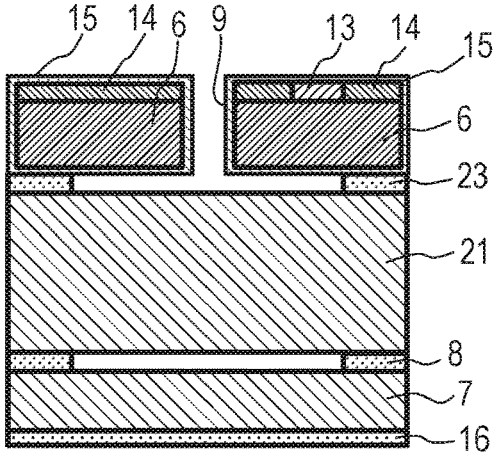
FIG. 11E is a cross-sectional view illustrating an example step of bonding a first substrate, the third substrate and the second substrate in the method of manufacturing a substrate illustrated in FIG. 10.

Next, the first substrate 6 illustrated in FIG. 11B, the third substrate 21 illustrated in FIG. 11C and the second substrate 7 illustrated in FIG. 11D overlap each other in this order. In this case, as illustrated in FIG. 11E, the surface of the first substrate 6 opposite to the element forming surface abuts on the joining material forming surface of the third substrate 21 and the first substrate 6 and the third substrate 21 are joined to each other by the substrate joining material 23. Further, the surface of the third substrate 21 opposite to the joining material forming surface abuts on the joining material forming surface of the second substrate 7 and the third substrate 21 and the second substrate 7 are joined to each other by the substrate joining material 8. In a case where each of the substrate joining materials 8 and 23 are a polyamide resin, the substrates 6, 7 and 21 are bonded together while being heated and pressed. When each of the substrate joining materials 8 and 23 are SiO, the substrates 6, 7 and 21 are subjected to plasma processing and bonded. In a case where it is difficult to join the first substrate 6, the third substrate 21 and the second substrate 7 at the same time, after the first substrate 6 and the third substrate 21 may be joined to each other, the second substrates 7 may be joined.

Figure 11F:
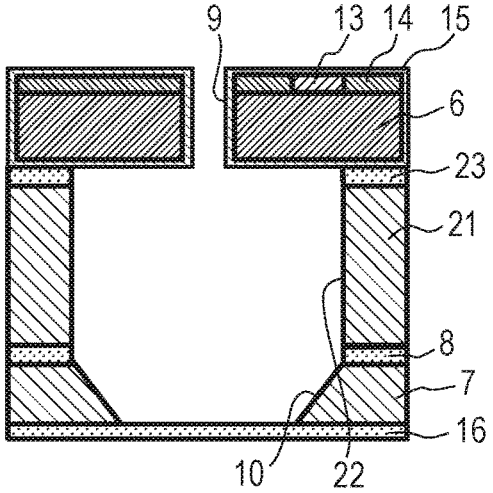
FIG. 11F is a cross-sectional view illustrating an example step of forming a supply path rear end portion by crystal anisotropic etching in the method of manufacturing the substrate illustrated in FIG. 10.
Figure 11G:
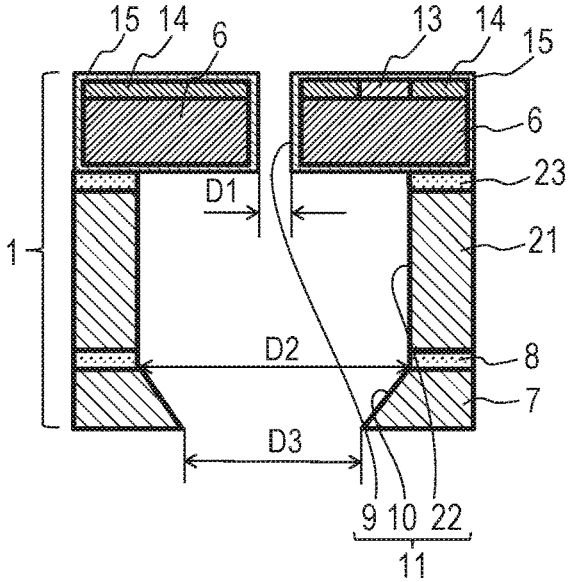
FIG. 11G is a cross-sectional view illustrating an example step of forming an opening portion of the supply path rear end portion by crystal anisotropic etching in the method of manufacturing the substrate illustrated in FIG. 10.

After the first substrate 6, the third substrate 21 and the second substrate 7 are joined to each other as described above, a silicon etching agent (For example, KOH or TMAH) is injected from the supply path front end portion 9 provided in the first substrate 6. The silicon etching agent does not etch the first substrate 6 covered with the resistant crystal anisotropic etching film 15 and etches a portion of the third substrate 21 which is not covered with the substrate joining material 23 functioning as a mask. By performing the crystal anisotropic etching on the single crystal silicon having a crystal orientation (110) constituting the third substrate 21, a hole portion is formed to penetrate the third substrate 21 from a surface (joining material forming surface) of the third substrate 21 closer to the first substrate 6 to a surface (a surface closer to the second substrate 7) of the third substrate 21 farther from the first substrate 6. As illustrated in FIG. 11F, the hole portion has a substantially constant width and forms the supply path intermediate portion 22 which extends linearly in a direction orthogonal to a thickness direction of the third substrate 21.

When the supply path intermediate portion 22 is formed in the third substrate 21 in this way, the silicon etching agent which has passed through the supply path intermediate portion 22 erodes a portion of the second substrate 7 which is not covered with the substrate joining material 8. Since the crystal anisotropic etching is performed on the single crystal silicon having the crystal orientation (100) constituting the second substrate 7, similarly to the first embodiment, a tapered supply path rear end portion 10 is formed from the side closer to the first substrate 6 toward the surface on which the resistant crystal anisotropic etching film 16 is formed. A width of an opening portion on the joining material forming surface of the supply path rear end portion 10 is defined as D2. The supply path rear end portion 10 may be completed by the crystal anisotropic etching. However, only a portion of the supply path rear end portion 10 may be formed by the crystal anisotropic etching and the crystal anisotropic etching may be terminated without penetrating the second substrate 7. In that case, dry etching, grinding or polishing may be performed on the opposite side of the joining material forming surface of the second substrate 7 in the later step so that the supply path rear end portion 10 penetrating the second substrate 7 is completed.

As illustrated in FIG. 11G, the resistant crystal anisotropic etching film 16 on the surface of the second substrate 7 opposite to the joining material forming surface is formed is removed. A width of an opening portion of the supply path rear end portion 10 on the surface opposite to the joining material forming surface is defined as D3.

Thus, the element substrate 1 (refer to FIGS. 10 and 11G), which is a laminate of the first substrate 6, the third substrate 21 and the second substrate 7, is formed. In the element substrate 1, the supply path front end portion 9 penetrating the first substrate 6, the supply path intermediate portion 22 penetrating the third substrate 21 and the supply path rear end portion 10 penetrating the second substrate 7 are connected to each other and thus, the liquid supply path 11 is configured. The width D1 of the surface of the supply path front end portion 9 of the first substrate 6 closer to the second substrate 7, the width D2 of the opening portion on the joining material forming surface of the supply path rear end portion 10 of the second substrate 7, and the width D3 of the opening portion on the surface opposite to the joining material forming surface have a relationship of D1<D2 and D3<D2. A center of the supply path front end portion 9, a center of the supply path intermediate portion 22 and a center of the supply path rear end portion 10 of the second substrate 7 may coincide with each other or may not coincide with each other.

Similarly to the first embodiment, the ejection orifice forming member 3 is laminated on the element forming surface side of the first substrate 6 of the element substrate 1 to form the pressure chambers 5 and the ejection orifices 4. Further, the support member 2 is joined to the side opposite to the joining material forming surface of the second substrate 7 of the element substrate 1 and thus, a liquid ejection head illustrated in FIG. 9 is configured.

Moreover, in the present embodiment, the widths D1 to D3 of the respective portions of the supply path front end portion 9 and the supply path rear end portion 10 have the relationship of D1<D2 and D3<D2. Accordingly, the strength of the element substrate 1 does not decrease, the formation region of the energy generating element 13 and the wiring region 14 are secured, the liquid supply path 11 inside the element substrate 1 is widened and a wide joint area between the element substrate 1, the support member 2 and the ejection orifice forming member 3 can be secured. In the manufacturing method of the present embodiment, after the third substrate 21 and the second substrate 7 are firmly joined to the first substrate 6 before the supply path intermediate portion 22 and the supply path rear end portion 10 are formed, the supply path intermediate portion 22 and the supply path rear end portion 10 can be formed by etching. Therefore, although the width of the supply path intermediate portion 22 in a completed state and the width D2 of the supply path rear end portion 10 in a completed state are large, joining strengths of the first to third substrates 6, 21 and 7 are high. In this manner, the element substrate 1 having the supply path front end portion 9 and the supply path rear end portion 10 having the above-described dimensional relationship can be easily formed without damaging the first to third substrates 6, 21 and 7.

Example 5

Figure 12A:
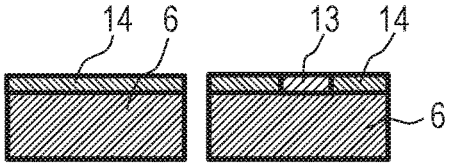
FIG. 12A is a cross-sectional view illustrating Example 5 of the method of manufacturing the substrate according to the present disclosure and relates to a step of forming an energy generating element, a wiring region and a through hole in the substrate.
Figure 12B:
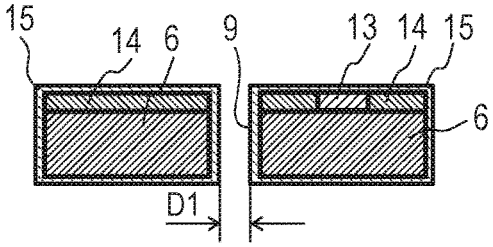
FIG. 12B is a cross-sectional view illustrating Example 5 of the method of manufacturing the substrate according to the present disclosure and relates to a step of forming an etching-resistant film on the substrate.

An example will be described based on the above-described second embodiment of the present disclosure. As illustrated in FIGS. 12A and 12B, the electrothermal conversion element which is an example of the energy generating element 13, the wire in the wiring region 14 and the through hole penetrating the first substrate 6 are formed on the first substrate 6 made of silicon. Then, a resistant crystal anisotropic etching film 15 which covers the entire surface of the first substrate 6 and also serves as an ink-resistant film is formed. The resistant crystal anisotropic etching film 15 is a titanium monoxide (TiO) film having a thickness of 0.3 The supply path front end portion 9 of the present example which is formed in this manner has a substantially constant width over the entire length and the width D1 of the supply path front end portion 9 is 50 μm.

Figure 12C:
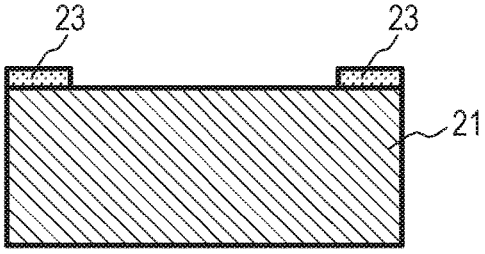
FIG. 12C is a cross-sectional view illustrating Example 5 of the method of manufacturing the substrate according to the present disclosure and relates to a step of performing etching on one surface of a third substrate and patterning the substrate joining material.

As illustrated in FIG. 12C, silicon having a crystal orientation (110) is cut out to form the third substrate 21 having a thickness of 300 μm. The substrate joining material 23 made of a polyamide resin film having a thickness of 2.0 μm is formed on one surface of the third substrate 21. The substrate joining material 23 has a sufficient thickness so that a silicon etching agent easily enters after the substrate joining material 23 is joined to the first substrate 6. However, the substrate joining material 23 may be a SiO film having a thickness of about 0.5 Exposure, development and etching are performed on the substrate joining material 23 so that the opening portion having a width (for example, 250 μm) larger than the width D1 of the opening portion of the supply path front end portion 9 is formed.

Figure 12D:
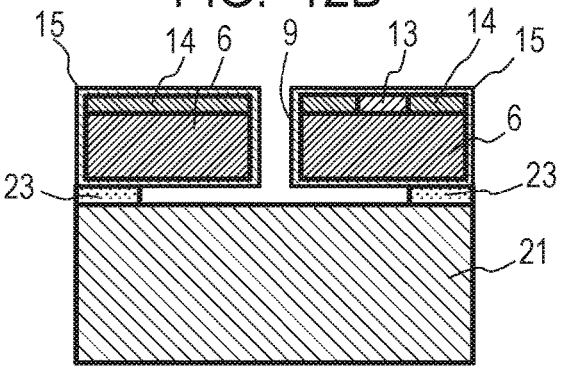
FIG. 12D is a cross-sectional view illustrating Example 5 of the method of manufacturing a substrate according to the present disclosure and relates to a step of bonding a first substrate and the third substrate.

In the present example, as illustrated in FIG. 12D, the first substrate 6 and the third substrate 21 overlap each other and are heated and pressurized, specifically, a state where a pressure of 5 kN is applied to the first substrate 6 and the third substrate 21 while heating the first substrate 6 and the third substrate 21 at 250° C. is maintained for 60 minutes and thus, the first substrate 6 and the third substrate 21 are joined to each other.

Figure 12E:
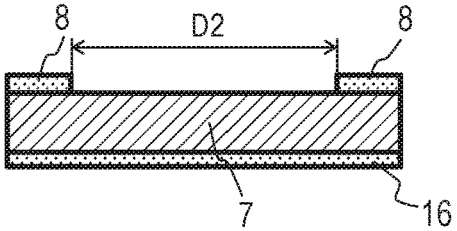
FIG. 12E is a cross-sectional view illustrating Example 5 of the method of manufacturing a substrate according to the present disclosure and relates to a step of forming a substrate joining material on one surface of the second substrate and a resistant crystal anisotropic etching film on the other surface of the second substrate.

As illustrated in FIG. 12E, silicon having a crystal orientation (100) is cut out to form the second substrate 7 having a thickness of 100 The substrate joining material 8 is applied to one surface of the second substrate 7 and a SiO film having a thickness of 0.5 μm is formed as the resistant crystal anisotropic etching film 16 on the other surface by a CVD method. The substrate joining material 8 of the present example is a polyamide resin film having a thickness of 2.0 μm similar to the thickness of the substrate joining material 23, and is exposed, developed and etched so that the opening portion having a width D2=250 μm is formed.

Figure 12F:
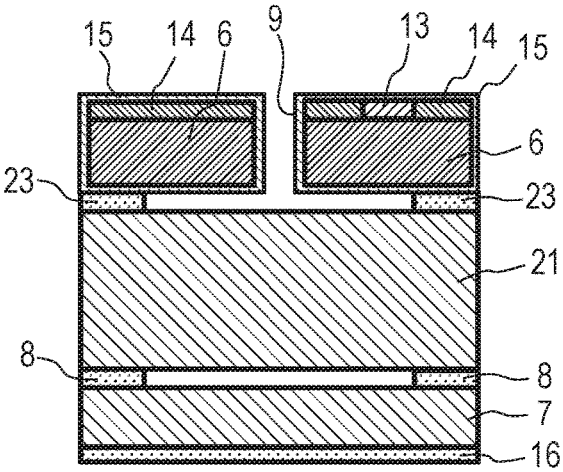
FIG. 12F is a cross-sectional view illustrating Example 5 of the method of manufacturing a substrate according to the present disclosure and relates to a step of bonding a first substrate, the third substrate and the second substrate.

As illustrated in FIG. 12F, the third substrate 21 joined to the first substrate 6 and the second substrate 7 overlap each other and a state where a pressure of 5 kN is applied to third substrate 21, first substrate 6 and the second substrate 7 while heating the third substrate 21, the first substrate 6 and the second substrate 7 to 250° C. is maintained for 60 minutes. Accordingly, the third substrate 21 and the second substrate 7 are joined to each other.

Figure 12G:
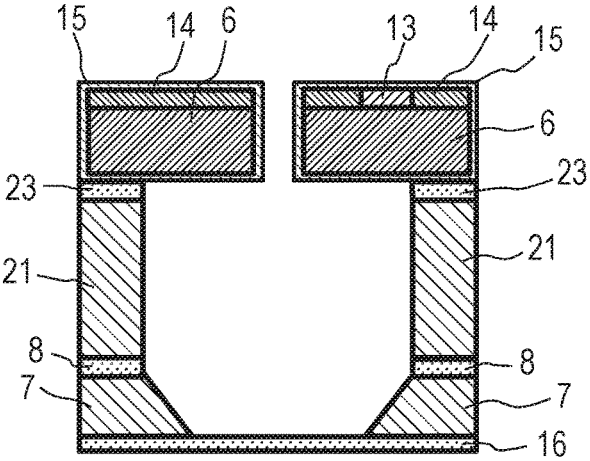
FIG. 12G is a cross-sectional view illustrating Example 5 of the method of manufacturing a substrate according to the present disclosure and relates to a step of forming a supply path rear end portion by crystal anisotropic etching.
Figure 12H:
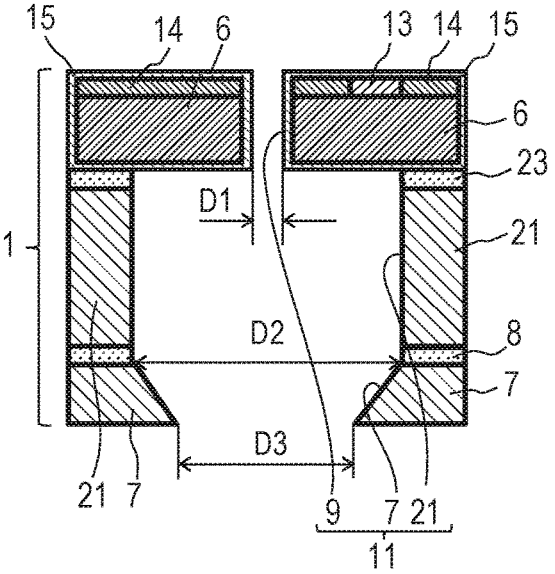
FIG. 12H is a cross-sectional view illustrating Example 5 of the method of manufacturing a substrate according to the present disclosure and relates to a step of forming an opening portion at the supply path rear end portion by crystal anisotropic etching.

Next, a cyclized rubber (not illustrated) which is a resistant silicon etching liquid is applied to an outer periphery of a laminate of the first to third substrates 6, 21 and 7. Then, the laminate is put into tetramethylammonium hydroxide (TMAH) having a temperature of 83° C. and a concentration of 25% and is held for 9 hours. TMAH, which is an etching liquid, flows in from the supply path front end portion 9 of the first substrate 6, reaches the third substrate 21 and etches a portion which is not covered with the substrate joining material 23. Since the third substrate 21 is a silicon plate having a crystal orientation (110), the etching progresses perpendicularly to a plane direction and as illustrated in FIG. 12G, the supply path intermediate portion 22 having a substantially constant width (250 μm). After that, the etching liquid which has passed through the supply path intermediate portion 22 reaches the second substrate 7 and etches a portion which is not covered with the substrate joining material 8. Since the second substrate 7 is silicon having a crystal orientation (100), the etching proceeds at an angle of 54.7° and a tapered hole portion is formed toward the resistant crystal anisotropic etching film 16. After the etching is completed, the etching liquid is washed away with water, the resistant crystal anisotropic etching film 16 is removed using BHF and the cyclized rubber is removed by side spraying. Accordingly, the element substrate 1 illustrated in FIG. 12H is completed. The width D3 on the surface of the supply path rear end portion 10 farther from the first substrate is 100 μm.

According to this manufacturing method, after the formation region of the energy generating element 13 and the wiring region 14 are sufficiently secured without damaging the element substrate 1 including the first to third substrates 6, 21, 7, the supply path front end portion 9, the supply path intermediate portion 22 and the supply path rear end portion 10 can be formed. The element substrate 1 can be formed, in which the width D2 of the opening portion of the supply path rear end portion 10 inside the element substrate 1 on the joint surface between the third substrate 21 and the second substrate 7 is wide and the width D3 of the opening portion on the joint surface between the element substrate 1 and the support member 2 is small.

Example 6

Example 6 of the element substrate 1 based on the second embodiment of the present disclosure will be described with reference to FIGS. 13A, 13B, 13C, 13D, 13E, 13F and 13G. Descriptions of the portions common to Example 5 are omitted. According to the present example, both the third substrate 21 and the second substrate 7 are formed of a silicon substrate having a crystal orientation (100).

Figure 13A:
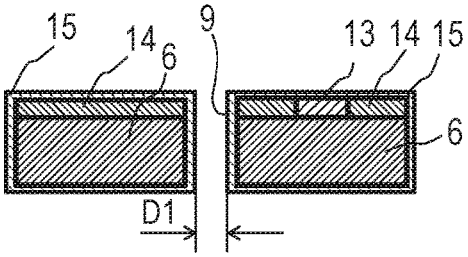
FIG. 13A is a cross-sectional view illustrating Example 6 of the method of manufacturing a substrate according to the present disclosure and relates to a step of forming an energy generating element, a wiring region, a through hole and a resistant crystal anisotropic etching film on the substrate.

First, as illustrated in FIG. 13A, similarly to Example 5, the energy generating element (electrothermal conversion element) 13, the wire in the wiring region 14, the supply path front end portion 9 and resistant crystal anisotropic etching film 15 are formed on the first substrate 6 made of silicon. The width D1 of the supply path front end portion 9 is 50 μm.

Figure 13B:
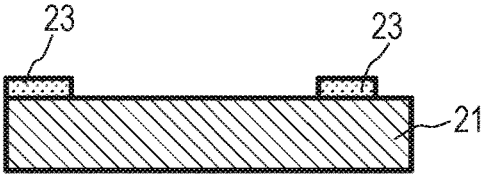
FIG. 13B is a cross-sectional view illustrating Example 6 of the method of manufacturing a substrate according to the present disclosure and relates to a step of performing etching on one surface of a third substrate and patterning a substrate joining material.

Next, as illustrated in FIG. 13B, the third substrate 21 which is made of silicon having a crystal orientation (100) and has a thickness of 100 μm is formed. The substrate joining material 23 made of a polyamide resin film having a thickness of 2.0 μm is formed on one surface of the third substrate 21. The width of the opening portion of the substrate joining material 23 is 250 μm.

Figure 13C:
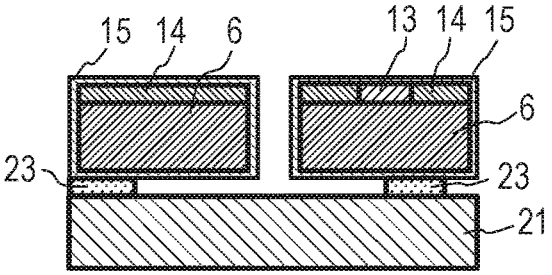
FIG. 13C is a cross-sectional view illustrating Example 6 of the method of manufacturing a substrate according to the present disclosure and relates to a step of bonding a first substrate and the third substrate.

As illustrated in FIG. 13C, the first substrate 6 and the third substrate 21 overlap each other, and a state where a pressure of 5 kN is applied to the first substrate 6 and the third substrate 21 while heating the first substrate 6 and the third substrate 21 to 250° C. is maintained for 60 minutes and thus, the first substrate 6 and the third substrate 21 are joined to each other.

Figure 13D:
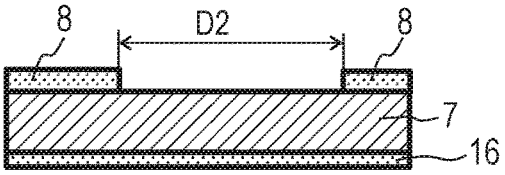
FIG. 13D is a cross-sectional view illustrating Example 6 of the method of manufacturing a substrate according to the present disclosure and relates to a step of forming a substrate joining material on one surface of a second substrate and a resistant crystal anisotropic etching film on the other surface of the second substrate.

As illustrated in FIG. 13D, the second substrate 7 which is made of silicon having a crystal orientation (100) and has a thickness of 100 μm is formed. The substrate joining material 8 is applied to one surface of the second substrate 7 and a SiO film having a thickness of 0.5 μm is formed as the resistant crystal anisotropic etching film 16 on the other surface by a CVD method. The substrate joining material 8 is a polyamide resin film having a thickness of 2.0 μm similar to the thickness of the substrate joining material 23 and the opening portion having a width D2=250 μm is formed in the substrate joining material 8.

Figure 13E:
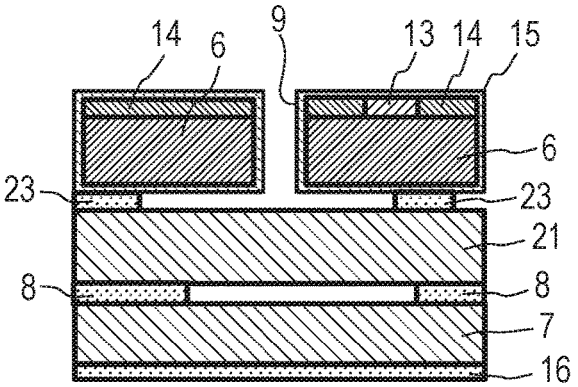
FIG. 13E is a cross-sectional view illustrating Example 5 of the method of manufacturing a substrate according to the present disclosure and relates to a step of bonding the first substrate, the third substrate and the second substrate.

As illustrated in FIG. 13E, the third substrate 21 joined to the first substrate 6 and the second substrate 7 overlap each other, and a state where a pressure of 5 kN is applied to the third substrate 21, first substrate 6 and the second substrate 7 while heating the third substrate 21, the first substrate 6 and the second substrate 7 to 250° C. is maintained for 60 minutes. Accordingly, the third substrate 21 and the second substrate 7 are joined to each other.

Figure 13F:
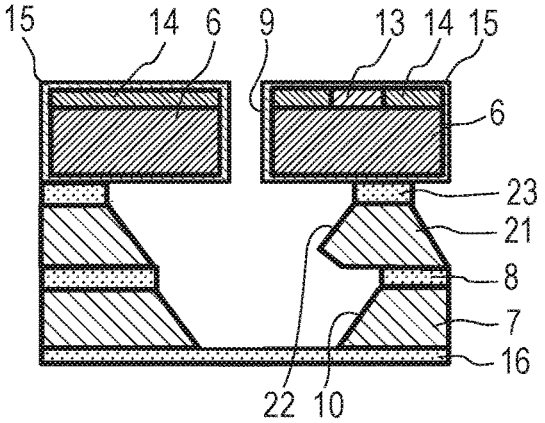
FIG. 13F is a cross-sectional view illustrating Example 5 of the method of manufacturing a substrate according to the present disclosure and relates to a step of forming the supply path rear end portion by crystal anisotropic etching.

A cyclized rubber (not illustrated) is applied to an outer periphery of a laminate of the first to third substrates 6, 21 and 7, and the laminate is put into tetramethylammonium hydroxide (TMAH) having a temperature of 83° C. and a concentration of 25% and is held for 6 to 7 hours. TMAH, which is an etching liquid, flows in from the supply path front end portion 9 of the first substrate 6, reaches the third substrate 21 and etches a portion which is not covered with the substrate joining material 23. Since the third substrate 21 is silicon having a crystal orientation (100), the etching proceeds at an angle of 54.7° and as illustrated in FIG. 13F, the supply path intermediate portion 22 which is a hole portion having a tapered shape toward the second substrate 7 is formed.

Figure 13G:
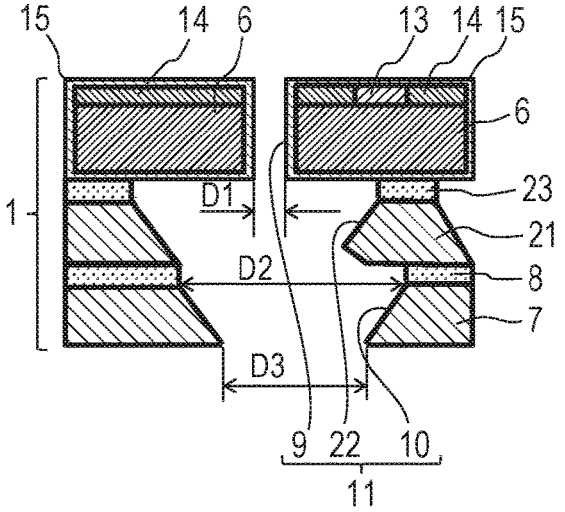
FIG. 13G is a cross-sectional view illustrating Example 5 of the method of manufacturing a substrate according to the present disclosure and relates to a step of forming the opening portion at the supply path rear end portion by crystal anisotropic etching.

When the etching liquid which has passed through the supply path intermediate portion 22 reaches the second substrate 7, since the second substrate 7 is also silicon having a crystal orientation (100), the second substrate 7 proceeds the etching at an angle of 54.7° similarly to the third substrate 21. As a result, a tapered hole portion is formed toward the resistant crystal anisotropic etching film 16. After the etching is completed, the etching liquid, the resistant crystal anisotropic etching film 16 and the cyclized rubber are removed, and the element substrate 1 illustrated in FIG. 13G is completed. The width D2 on the surface of the supply path rear end portion 10 closer to the first substrate is 250 μm and the width D3 on the surface of the supply path rear end portion 10 farther from the first substrate 6 is 100 μm.

Also in this manufacturing method, after the formation region of the energy generating element 13 and the wiring region 14 are sufficiently secured without damaging the element substrate 1 including the first to third substrates 6, 21, 7, the supply path front end portion 9, the supply path intermediate portion 22 and the supply path rear end portion 10 can be formed. The element substrate 1 can be formed, in which the width D2 of the opening portion of the supply path rear end portion 10 inside the element substrate 1 on the joint surface between the third substrate 21 and the second substrate 7 is wide and the width D3 of the opening portion on the joint surface between the element substrate 1 and the support member 2 is small.

The substrate and the method of manufacturing the same according to the present disclosure are not limited to the element substrate of the liquid ejection head and can be applied to various substrates having a supply path through which a liquid flows in a device such as a MEMS device and a method of manufacturing the same.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-111877, filed Jun. 17 2019, which is hereby incorporated by reference here in its entirety.

What is claimed is:

1. A substrate having a liquid supply path, the substrate comprising:

a first substrate which includes a first substrate through hole; and a second substrate which includes a second substrate through hole and directly or indirectly overlaps the first substrate, wherein the first substrate through hole and the second substrate through hole directly or indirectly communicate with each other to form a liquid supply path, wherein a width D1 of an opening portion of the first substrate through hole on a surface of the first substrate closer to the second substrate, a width D2 of an opening portion of the second substrate through hole on a surface of the second substrate closer to the first substrate and a width D3 of an opening portion of the second substrate through hole on a surface of the second substrate farther from the first substrate have a relationship of D1<D2 and D3<D2, wherein the second substrate through hole has a tapered shape from the surface of the second substrate closer to the first substrate toward the surface of the second substrate farther from the first substrate, wherein the second substrate is a silicon substrate having a crystal orientation of (100), and wherein the width D2 and the width D3 of the opening portions of the second substrate through hole have a relationship of D2=T1/tan 54.7°×2+D3, where T1 is a thickness of the second substrate.

2. The substrate according to claim 1, wherein the first substrate through hole penetrates the first substrate at a constant width from a surface of the first substrate farther from the second substrate to the surface of the first substrate closer to the second substrate.

3. The substrate according to claim 1, wherein an etching-resistant film is formed on at least the surface of the first substrate closer to the second substrate.

4. The substrate according to claim 1, wherein the first substrate and the second substrate are directly joined to each other by a substrate joining material.

5. The substrate according to claim 4, wherein the substrate joining material is a resin material.

6. The substrate according to claim 1, wherein the first substrate and the second substrate indirectly overlap each other so that a third substrate having a third substrate through hole is interposed therebetween and the first substrate through hole and the second substrate through hole indirectly communicate with each other via the third substrate through hole to constitute the liquid supply path.

7. The substrate according to claim 6, wherein the third substrate through hole penetrates the third substrate at a constant width from a surface of the third substrate closer to the first substrate to a surface of the third substrate closer to the second substrate.

8. The substrate according to claim 7, wherein the third substrate is a silicon substrate having a crystal orientation of (110).

9. The substrate according to claim 6, wherein the third substrate through hole has a tapered shape from a surface of the third substrate closer to the first substrate toward a surface of the third substrate closer to the second substrate.

10. The substrate according to claim 6, wherein a width of an opening portion of the third substrate through hole at least on a surface of the third substrate closer to the second substrate is equal to a width D2 of the second substrate through hole.

11. A liquid ejection head comprising:

a substrate which includes a liquid supply path, a first substrate having a first substrate through hole and a second substrate having a second substrate through hole and directly or indirectly overlapping the first substrate, in which the first substrate through hole and the second substrate through hole directly or indirectly communicate with each other to form the liquid supply path, and a width D1 of an opening portion of the first substrate through hole on a surface of the first substrate closer to the second substrate, a width D2 of an opening portion of the second substrate through hole on a surface of the second substrate closer to the first substrate and a width D3 of an opening portion of the second substrate through hole on a surface of the second substrate farther from the first substrate have a relationship of D1<D2 and D3<D2, wherein the second substrate through hole has a tapered shape from the surface of the second substrate closer to the first substrate toward the surface of the second substrate farther from the first substrate, wherein the second substrate is a silicon substrate having a crystal orientation of (100), and wherein the width D2 and the width D3 of the opening portions of the second substrate through hole have a relationship of D2=T1/tan 54.7°×2+D3, where T1 is a thickness of the second substrate;

an ejection orifice forming member which is joined to the first substrate and has an ejection orifice communicating with the first substrate through hole; and a support member which is joined to the second substrate and having a support member flow path communicating with the second substrate through hole.

12. The liquid ejection head according to claim 11, wherein a pressure chamber communicating with the first substrate through hole is formed between the ejection orifice forming member and the first substrate, and the ejection orifice communicates with a portion of the pressure chamber, and wherein an energy generating element and a wiring region located inside the pressure chamber are provided on a surface of the first substrate which is joined to the ejection orifice forming member.

13. A manufacturing method of a substrate comprising:

directly or indirectly overlapping a first substrate which has a first substrate through hole and a second substrate which does not have a second substrate through hole; and introducing an etching liquid from the first substrate through hole of the first substrate directly or indirectly overlapping the second substrate so that the etching liquid reaches the second substrate, and forming the second substrate through hole directly or indirectly communicating with the first substrate through hole in the second substrate, wherein the second substrate through hole is formed so that a width D1 of an opening portion of the first substrate through hole on a surface of the first substrate closer to the second substrate, a width D2 of an opening portion of the second substrate through hole on a surface of the second substrate closer to the first substrate and a width D3 of an opening portion of the second substrate through hole on a surface of the second substrate farther from the first substrate satisfy a relationship of D1<D2 and D3<D2, wherein the second substrate through hole has a tapered shape from the surface of the second substrate closer to the first substrate toward the surface of the second substrate farther from the first substrate, wherein the second substrate is a silicon substrate having a crystal orientation of (100) and the second substrate through hole is formed in the second substrate by crystal anisotropic etching, and wherein the width D2 and the width D3 of the opening portions of the second substrate through hole have a relationship of $D2=T1/\tan 54.7°\times 2+D3$, where T1 is a thickness of the second substrate.

* * * * *